US009631822B2

(12) United States Patent
Kojima et al.

(10) Patent No.: US 9,631,822 B2
(45) Date of Patent: Apr. 25, 2017

(54) AIR CONDITIONER

(75) Inventors: Kazuhito Kojima, Tokyo (JP); Toshihiro Hotta, Tokyo (JP); Tetsuya Tazawa, Tokyo (JP); Hiroshi Ohmura, Tokyo (JP); Yasushi Oba, Tokyo (JP); Takuya Goto, Tokyo (JP); Den Ozaki, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 1721 days.

(21) Appl. No.: 12/854,454

(22) Filed: Aug. 11, 2010

(65) Prior Publication Data

US 2011/0113807 A1 May 19, 2011

(30) Foreign Application Priority Data

Nov. 18, 2009 (JP) ..... 2009-262839

(51) Int. Cl.
*F24F 1/00* (2011.01)
*F24F 13/20* (2006.01)

(52) U.S. Cl.
CPC ..... *F24F 1/0007* (2013.01); *F24F 2013/207* (2013.01)

(58) Field of Classification Search
USPC ..... 62/262, 298, 419; 220/560.01, 3.2, 3.92, 220/3.94, 495.01, 560.03, 4.01, 4.02, 220/88.1, 23.89, 23.87, 4.21, 780, 784; 403/348, 349; 411/549–553; 24/663
See application file for complete search history.

(56) References Cited

U.S. PATENT DOCUMENTS 5,702,021 A * 12/1997 Ito ..... 220/326
2008/0060923 A1* 3/2008 Sugino et al. ..... 200/331

FOREIGN PATENT DOCUMENTS

CN 1143733 A 2/1997
GB 2 304 400 A 3/1997
GB 2304400 A * 3/1997
JP 10-38313 A 2/1998
(Continued)

OTHER PUBLICATIONS

Office Action issued by the Chinese Patent Office on Dec. 4, 2012 in corresponding Chinese Patent Application No. 2010102904163, and an English translation thereof.
(Continued)

*Primary Examiner* — Len Tran
*Assistant Examiner* — Zachary R Anderegg
(74) *Attorney, Agent, or Firm* — Buchanan Ingersoll & Rooney PC

(57) ABSTRACT

A locking claw on an outer face of a container portion made of resin is engaged with a locking hole in an outer periphery of a case made of sheet metal, the container portion being covered by the case, a locking claw on an outer face of a cover is engaged with a locking hole in an outer periphery of a lid body, the cover being covered by the lid body, they are assembled so that a part of an opening edge of an opening portion of the case is covered by an opening edge of an opening portion of the cover, the container portion and the case as well as the cover and the lid body are fixed to form an electric equipment box and a flame spread inhibiting path is formed between the lid body and the case.

8 Claims, 6 Drawing Sheets

(56) References Cited

FOREIGN PATENT DOCUMENTS

| | | | |
|---|---|---|---|
| JP | 10-78242 | A | 3/1998 |
| JP | 10-132326 | A | 5/1998 |
| JP | 10-339472 | A | 12/1998 |
| JP | 2001-296041 | A | 10/2001 |
| JP | 2007-120821 | A | 5/2007 |
| KR | 2002-0065085 | A | 8/2002 |

OTHER PUBLICATIONS

Office Action (Notification of Reasons for Refusal) dated Jan. 10, 2012, issued in the corresponding Japanese Patent Application No. 2009-262839, and an English Translation thereof. (5 pages).

Extended European Search Report dated Oct. 7, 2013, issued by the European Patent Office in corresponding European Patent Application No. 10008470.6-1602/2325572. (5 pages).

* cited by examiner

AIR CONDITIONER

BACKGROUND OF THE INVENTION

1. Field of the Invention

The present invention relates to a wall-hung type air conditioner provided with a heat exchanger, a fan, and an electric equipment box inside a main body of an indoor unit.

2. Description of the Related Art

With regard to a prior-art air conditioner, in an indoor unit of a wall-hung type air conditioner provided with a heat exchanger, a fan, and an electric equipment box inside a main body of the indoor unit, the electric equipment box includes a portion in which a case made of sheet metal is fitted around a container portion made of resin containing an electric substrate, a lid body made of sheet metal covering the center part and an upper part of an opening in the container portion, and a cover made of resin covering a lower part of the opening of the container portion, and the lid body made of the sheet metal includes an engagement claw at an upper part thereof to be inserted into the case of the electric equipment box and the cover made of the resin includes an engagement claw for pressing the lower part of the lid body made of sheet metal (See patent documents No. 1, for example).

The patent documents No. 1: Japanese Unexamined Patent Application Publication No. 10-339472 (page 1, FIG. 2).

SUMMARY OF THE INVENTION

With regard to the prior-art air conditioner, if an electronic component or the like catches fire inside the electric equipment box in the main body of the indoor unit, the container portion made of resin or the engagement claw of the cover made of resin might be burned by the flame and melted, and there is a risk that the flame might spread to the main body of the electric equipment box, a design panel and the like from a locking hole of the case made of sheet metal or the lid body made of sheet metal or a gap in an abutted-and-bent portion of the sheet metal.

The present invention was made in order to solve the above problems and an object thereof is to obtain an air conditioner in which even if a flame is generated inside the electric equipment box, the flame does not spread to the outside thereof.

An air conditioner according to the present invention includes, in a wall-hung type air conditioner provided with a heat exchanger, a fan, and an electric equipment box in a main body of an indoor unit, the electric equipment box includes a container portion made of resin containing a control board, a terminal block and the like and having an opening portion in which a locking claw is disposed on the outer peripheral face, a case made of sheet metal having an opening portion having a locking hole engaged with the locking claw of the container portion on the outer periphery, a cover made of resin having an opening portion having a locking claw on the outer peripheral face, and a lid body made of sheet metal having an opening portion having a locking hole engaged with the locking claw of the cover on the outer periphery, the locking claw of the container portion is engaged with the locking hole of the case so as to cover the outer peripheral face of the container portion by the case, the locking claw of the cover is engaged with the locking hole of the lid body so as to cover the outer peripheral face of the cover by the lid body, they are assembled so that a part of an opening edge of the opening portion of the case covering the container portion is covered by an opening edge of the opening portion of the cover covered by the lid body, the container portion and the case as well as the cover and the lid body are fixed by fastening means, and a flame spread inhibiting path of a predetermined length is formed between an opening end of the lid body and an opening end of the case, in which the opening edge of the lid body and the opening edge of the case overlap.

According to the air conditioner according to the present invention, the locking claw disposed on the outer peripheral face of the container portion made of resin in which the control board, the terminal block and the like are contained is engaged with the locking hole disposed in the outer periphery of the case made of sheet metal so as to cover the outer peripheral face of the container portion by the case, the locking claw disposed on the outer peripheral face of the cover is engaged with the locking hole disposed in the outer periphery of the lid body so as to cover the outer peripheral face of the cover by the lid body, they are assembled so that a part of the opening edge of the opening portion in the case covering the container portion is covered by the opening edge of the opening portion of the cover covered by the lid body, the electric equipment box is formed by fixing the container portion and the case as well as the cover and the lid body by the fastening means, and the flame spread inhibiting path of a predetermined length is formed between the opening end of the lid body and the opening end of the case, in which the opening edge of the lid body and the opening edge of the case overlap. Thus, if a fire occurs due to tracking or the like from the contained control board, the terminal block and the like, even if the engagement claw of the container portion is burned and melted, the engagement hole of the case is usually covered by the lid body. Then, the flame does not leave the electric equipment box and because of the flame spread inhibiting path, even if the container portion and the cover are burned and melted, the flame in the electric equipment box can be reliably prevented from leaving the assembled portions between the container portion of the electric equipment box and the case and between the cover and the lid body, and spread of flame to the main body, the design panel and the like of the indoor unit can be prevented.

DESCRIPTION OF THE PREFERRED EMBODIMENTS

Embodiment 1

Figure 1:
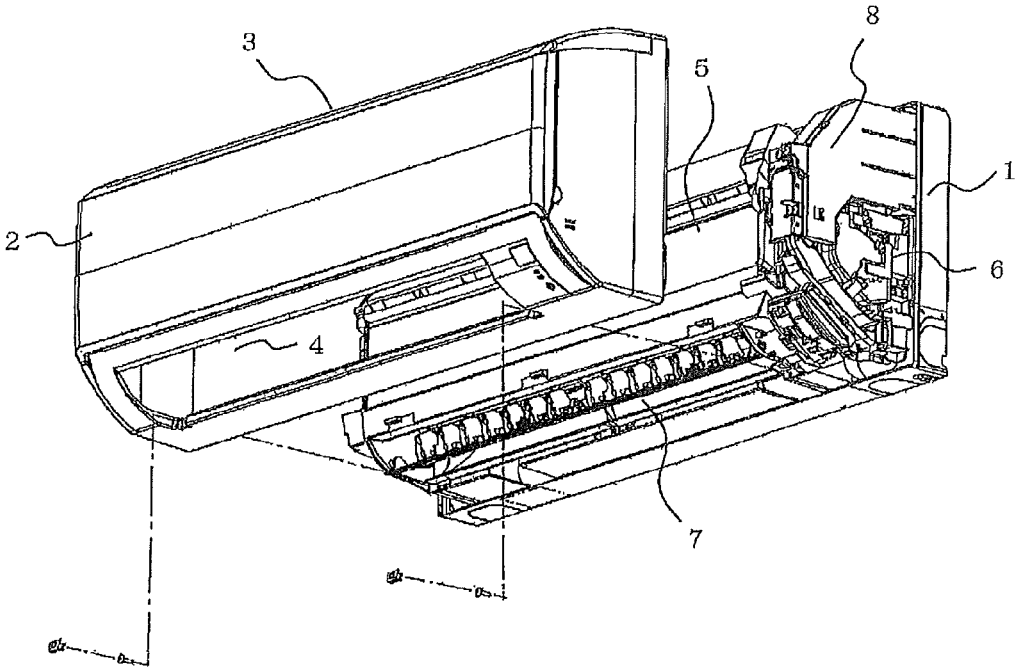
FIG. 1 is an exploded perspective view illustrating an indoor unit of an air conditioner of Embodiment 1 of the present invention.
Figure 2:
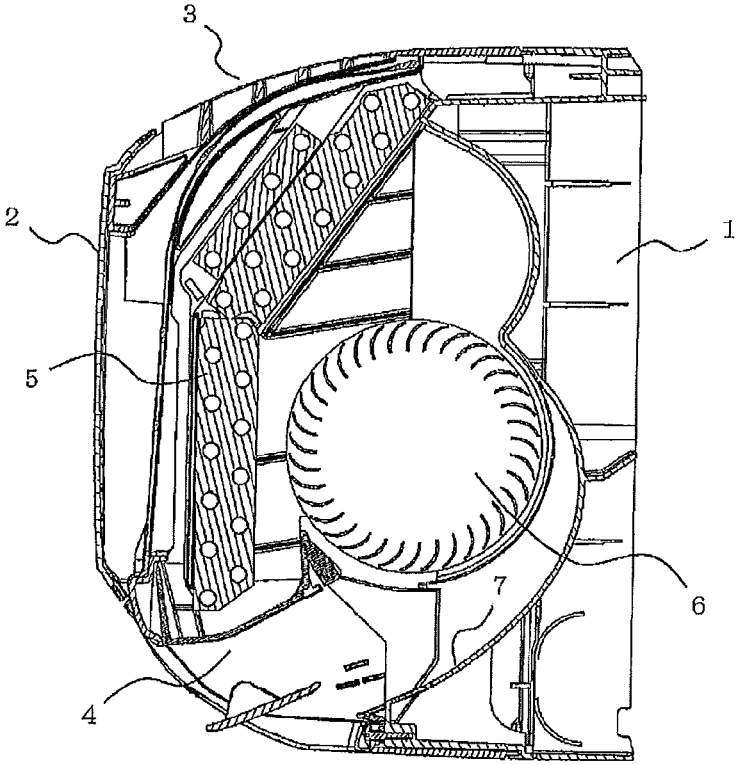
FIG. 2 is a longitudinal sectional view of the center in a main body of the indoor unit of the air conditioner.
Figure 3:
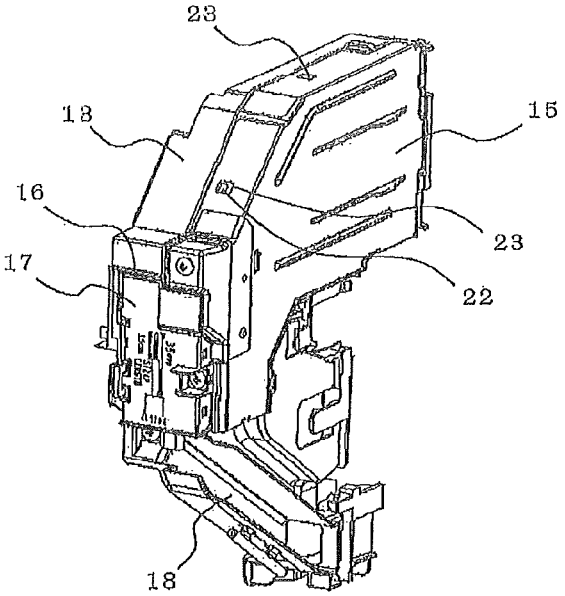
FIG. 3 is a perspective view illustrating an electric equipment box of the indoor unit of the air conditioner.
Figure 4:
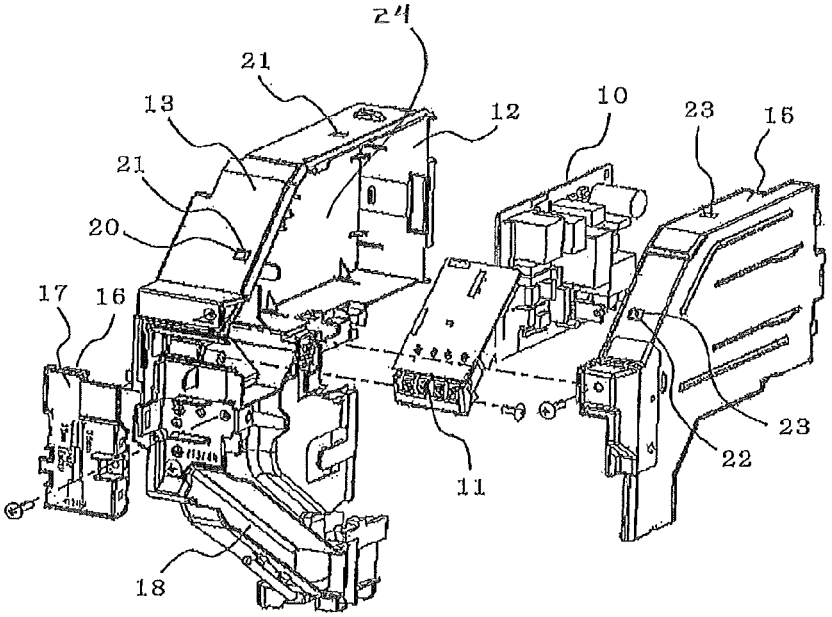
FIG. 4 is an exploded perspective view illustrating the electric equipment box of the indoor unit of the air conditioner.
Figure 5:
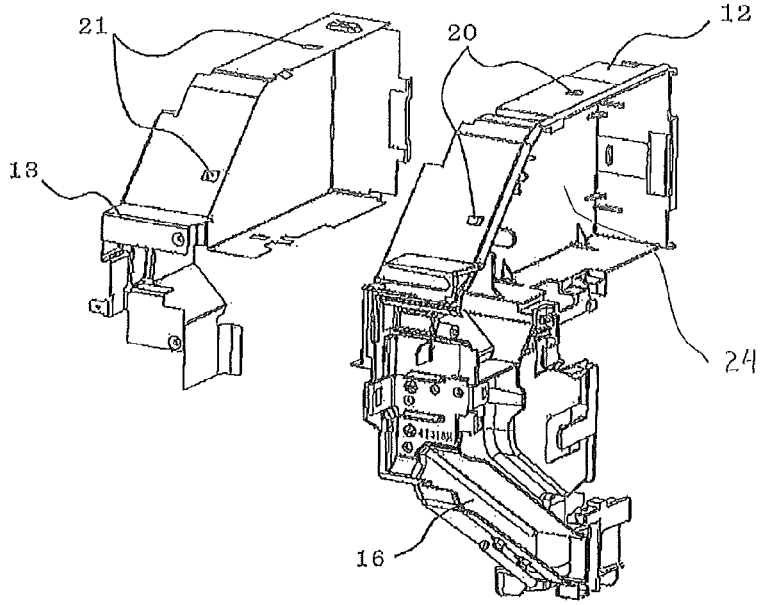
FIG. 5 is an exploded perspective view of a container portion and a case of the electric equipment box of the indoor unit of the air conditioner.
Figure 6:
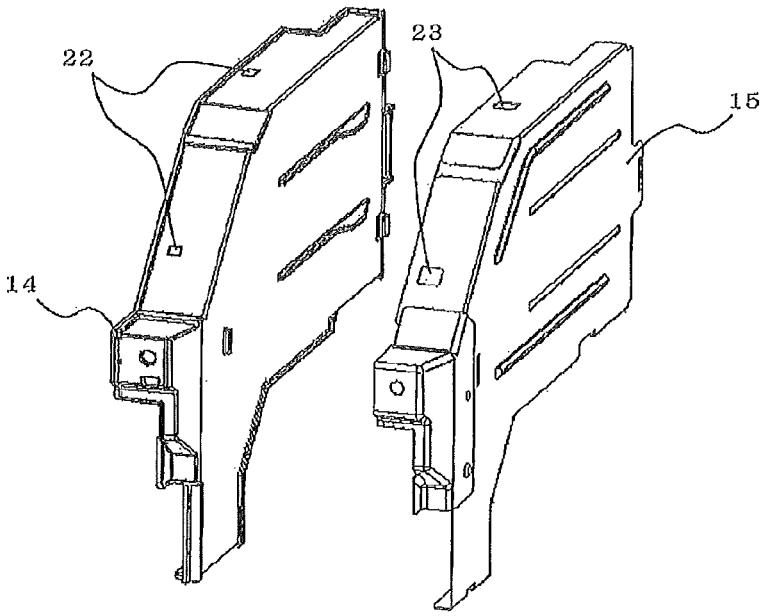
FIG. 6 is an exploded perspective view of a cover and a lid body of the electric equipment box of the indoor unit of the air conditioner.
Figure 7:
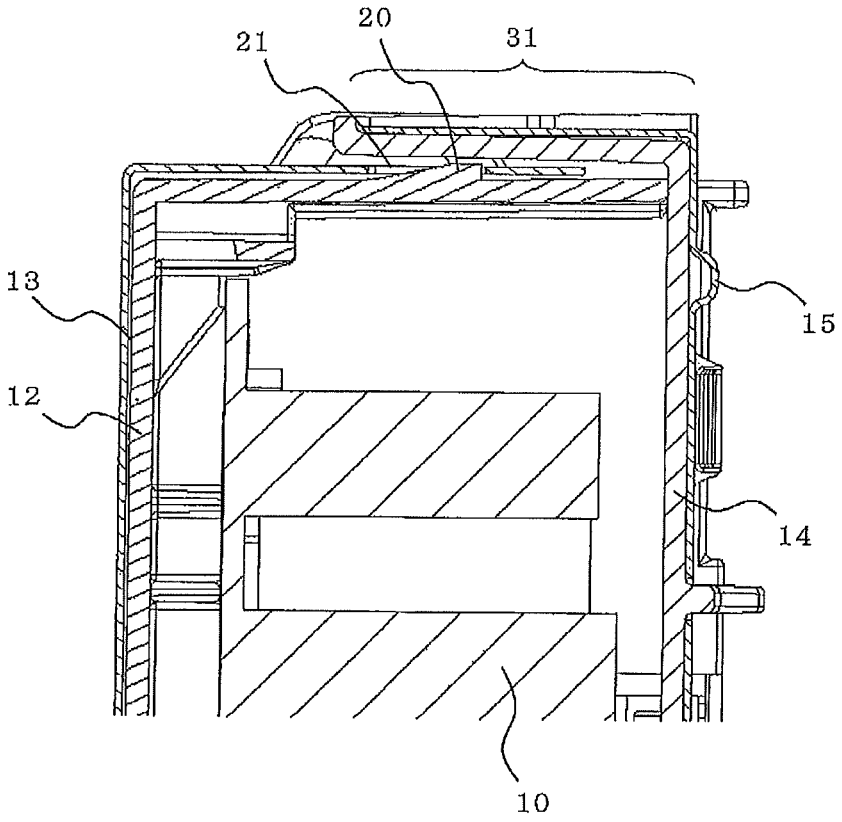
FIG. 7 is a sectional view of a portion around a locking claw of the container portion in the electric equipment box of the indoor unit of the air conditioner.

FIG. 1 is an exploded perspective view illustrating an indoor unit of an air conditioner of Embodiment 1 of the present invention, FIG. 2 is a longitudinal sectional view of the center in a main body of the indoor unit of the air conditioner, FIG. 3 is a perspective view illustrating an electric equipment box of the indoor unit of the air conditioner, FIG. 4 is an exploded perspective view illustrating the electric equipment box of the indoor unit of the air conditioner, FIG. 5 is an exploded perspective view of a container portion and a case of the electric equipment box of the indoor unit of the air conditioner, FIG. 6 is an exploded perspective view of a cover and a lid body of the electric equipment box of the indoor unit of the air conditioner, and FIG. 7 is a sectional view of a portion around a locking claw of the container portion in the electric equipment box of the indoor unit of the air conditioner.

As shown in FIGS. 1 and 2, the air conditioner of Embodiment 1 of the present invention is of a separate type and includes a wall-hung indoor unit and an outdoor unit (not shown) that performs air conditioning of indoor air, in which a main body 1 of the indoor unit has a design panel 2 which covers components inside on the front face side, an inlet 3 that sucks the indoor air disposed on a top face, and an outlet 4 that feeds heat-exchanged air into the room on a lower front face.

In the main body 1 of the indoor unit, a heat exchanger 5 that cools or over-heats the indoor air, a fan 6 that blows the indoor air, and a fan casing 7 that forma an air path along which the air that has passed through the heat exchanger 5 is led to the outlet 4 of the design panel 2.

Also, as shown in FIG. 1, on the right side of the air path of the fan casing 7 in the main body 1 of the indoor unit, an electric equipment box 8 that drives the fan 6 or the like is arranged.

As shown in FIGS. 3 and 4, the electric equipment box 8 includes a container portion 12 made of flame-resistant resin and having one face of the box thereof shape open so as to receive a control board 10, a terminal block 11 or the like, a case 13 made of sheet metal and covering the outer peripheral face other than an opening portion 24 of the container portion 12, a cover 14 made of flame-resistant resin, having one face of the box shape thereof open and covering the outer periphery other than the opening portion of the case 13, is slightly larger than the outer periphery and is removable by a screw or the like, a lid body 15 made of sheet metal and covering the outer peripheral faces other than the opening portion of the cover 14, a terminal block cover 16 made of flame-resistant resin and covering the terminal block 11, and a terminal block case 17 made of sheet metal and covering the terminal block cover 16.

An internal/external connection line (not shown) is connected to the terminal block 11. Reference numeral 18 denotes a connection-line guiding member provided so as to be continuous with the container portion 12 and guiding the internal/external connection line to the terminal block 11.

As shown in FIG. 5, two locking claws 20 are disposed on the outer peripheral faces, other than the opening portion of the container portion 12 in the electric equipment box 8, while two locking holes 21 engaged with the locking claws 20 in the container portion 12 are disposed in the outer periphery other than the opening portion of the case 13 covering the container portion 12.

As shown in FIG. 6, two locking claws 22 are disposed on the outer peripheral faces, other than the opening portion of the cover 14, and two locking holes 23 engaged with the locking claws 22 of the cover 14 are disposed in the outer periphery, other than the opening portion of the lid body 15 covering the cover 14.

As shown in FIG. 7, a flame spread inhibiting path 31 of a predetermined length in which the opening edge of the lid body 15 and the portion of the opening edge of the case 13 overlap is formed between the opening end of the lid body 15 and the opening end on the locking hole 21 side of the case 13.

Subsequently, assembling of the electric equipment box 8 will be described.

First, the locking claws 20 disposed on the outer peripheral faces of the container portion 12 made of resin and containing the control board 10, the terminal block 11 and the like are engaged with the locking holes 21 disposed in the outer periphery of the case 13 made of sheet metal, and the outer peripheral face of the container portion 12 is covered by the case 13.

Subsequently, the locking claws 22 disposed on the outer peripheral face of the cover 14 are engaged with the locking holes 23 disposed in the outer periphery of the lid body 15, and the outer peripheral face of the cover 14 is covered by the lid body 15.

Then, the components are assembled so that a part of the opening edge of the opening portion of the case 13 covering the container portion 12 is covered by the opening edge of the opening portion of the cover 14 covered by the lid body 15. At this time, the flame spread inhibiting path 31 of a predetermined length in which the opening edge of the lid body 15 and the opening edge of the case 13 overlap is formed between the opening end of the lid body 15 and the opening end on the locking hole 21 side of the case 13.

Lastly, the container portion 12 and the case 13 as well as the cover 14 and the lid body 15 are fixed by a screw, which is the fastening means, so as to form the electric equipment box 8.

Subsequently, an operation of the indoor unit of the air conditioner of Embodiment 1 of the present invention will be described.

In the main body 1 of the indoor unit, when power is turned on, the fan 6 is driven by a control circuit of the control board 10 in the electric equipment box 8, the indoor air is sucked into the main body 1 through the inlet 3 of the design panel 2 and passes through the heat exchanger 5 so as to be cooled or over-heated, further passes through the fan casing 7 and is blown out into the room through the outlet 4 of the design panel 2.

The electric equipment box 8 contains the control board 10, the terminal block 11 and the like in the container portion 12, the terminal block cover 16 that is integrated with the terminal block case 17 fixed by a screw in installation of the indoor unit is removed from the container portion 12, the internal/external connection line is connected to the terminal block 11, and the terminal block cover 16 is mounted to the container portion 12 again so that power can be supplied to the indoor unit and the outdoor unit.

Also, in the case where there is a defect in the control board 10, the terminal block 11 or the like, the lid body 15 integrated with the cover 14 fixed by a screw is removed from the container portion 12, and the control board 10, the terminal block 11 or the like can be removed from the container portion 12.

With regard to the electric equipment box 8, in the case of fire due to tracking or the like from the control board 10, the terminal block 11 and the like contained therein, the container portion 12 made of resin, the cover 14, and the terminal block cover 16 are made of flame-resistant resin in order to prevent spread of the flame to the main body 1, the design panel 2 and the like, and moreover, the outer peripheries of the container portion 12, the cover 14, and the terminal block cover 16 are covered by the case 13, the lid body 15, and the terminal block case 17 made of sheet metal, respectively.

As mentioned above, in Embodiment 1, the container portion 12, the cover 14, and the terminal block cover 16 included in the electric equipment box 8 of the indoor unit are made of flame-resistant resin, the case 13, the lid body 15, and the terminal block case 17 covering the container portion 12, the cover 14, and the terminal block cover 16, respectively, are made of sheet metal, and the locking holes 21 of the case 13 engaged with the locking claws 20 of the container portion 12 are usually covered by the lid body 15. Thus, in the case of a fire due to tracking or the like from the contained control board 10, the terminal block 11 and the like, even if the locking claws 20 of the container portion 12 are burned and melted, the locking holes 21 of the case 13 are covered by the lid body 15, and the flame does not leave the electric equipment box 8, and spread of the flame to the main body 1, the design panel 2 and the like of the indoor unit can be prevented.

Moreover, the flame spread inhibiting path 31 of a predetermined length is formed in which the opening edge portion of the lid body 15 and the opening edge portion of the case 13 overlap between the opening end of the lid body 15 and the opening end on the locking hole 21 side of the case 13. Thus, even if the container portion 12 and the cover 14 are burned and melted, the flame in the electric equipment box 8 is reliably prevented from leaving the assembled portion between the container portion 12 and the case 13 and between the cover 14 and the lid body 15, and spread of the flame to the main body 1, the design panel 2 and the like of the indoor unit can be prevented.

Embodiment 2

Figure 8:
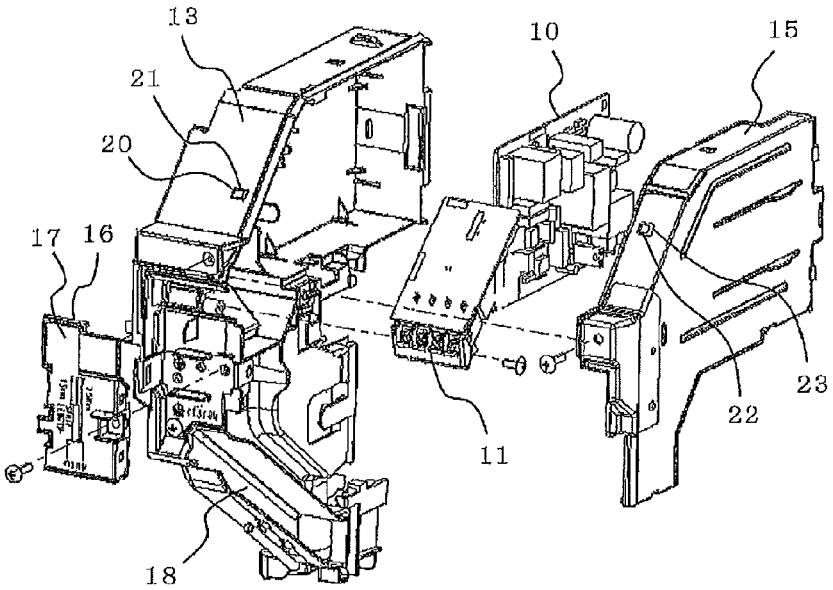
FIG. 8 is an exploded perspective view illustrating an electric equipment box in an indoor unit of an air conditioner of Embodiment 2 of the present invention.

FIG. 8 is an exploded perspective view illustrating an electric equipment box in an indoor unit of an air conditioner of Embodiment 2 of the present invention.

This Embodiment 2 is different from Embodiment 1 in the positions of the locking claws 20 of the container portion 12 and the locking holes 21 of the case 13 and in the positions of the locking claws 22 of the cover 14 and the locking holes 23 of the lid body 15.

In Embodiment 1, as shown in FIG. 4, the positions of the locking claws 20 of the container portion 12 and the locking holes 21 of the case 13 can be aligned in the same straight line with the positions of the locking claws 22 of the cover 14 and the locking holes 23 of the lid body 15 in the horizontal direction, but in Embodiment 2, as shown in FIG. 8, the positions of the locking claw 20 of the container portion 12 and the locking hole 21 of the case 13 and the positions of the locking claw 22 of the cover 14 and the locking hole 23 of the lid body 15 are displaced from each other so that they do not linearly overlap in the same straight line in the horizontal direction.

As mentioned above, in Embodiment 2, since the positions of the locking claw 20 of the container portion 12 and the locking hole 21 of the case 13 and the positions of the locking claw 22 of the cover 14 and the locking hole 23 of the lid body 15 are displaced from each other so that they do not linearly overlap in the same straight line in the horizontal direction, in the case of a fire due to tracking or the like from the control board 10, the terminal block 11 and the like contained in the container portion 12, the locking claw 20 is melted and passes through the locking hole 21 of the case 13, but the cover 14 is located over the locking hole 21 and the lid body 15 made of sheet metal is located over the cover, and thus, the flame does not leave the electric equipment box 8, and spread of the flame to the main body 1, the design panel 2 and the like of the indoor unit can be reliably prevented.

Embodiment 3

Figure 9:
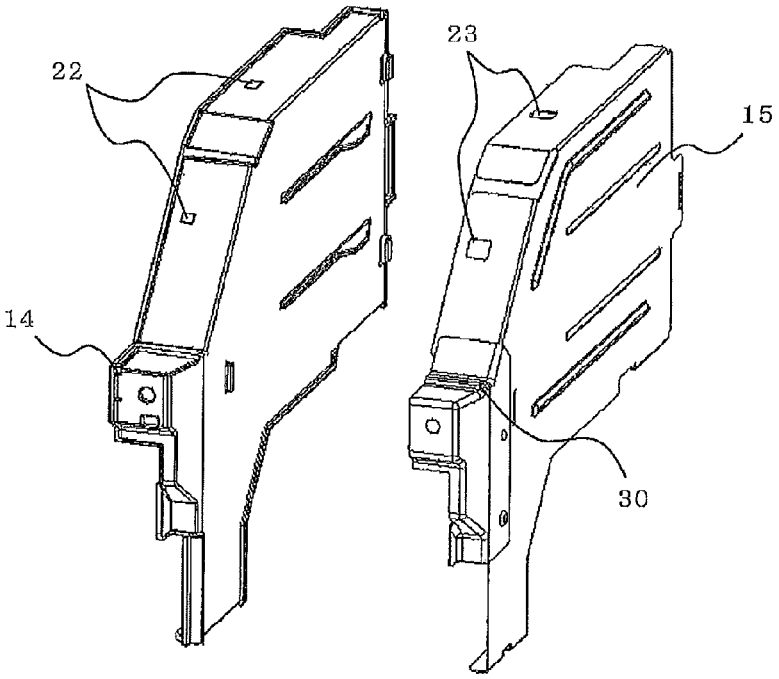
FIG. 9 is an exploded perspective view of a cover and a lid body of an electric equipment box in an indoor unit of an air conditioner of Embodiment 3 of the present invention.

FIG. 9 is an exploded perspective view of a cover and a lid body of an electric equipment box in an indoor unit of an air conditioner of Embodiment 3 of the present invention.

This Embodiment 3 is different from Embodiment 1 in the forming method of the lid body 15.

In Embodiment 1, as shown in FIG. 6, the outer periphery of the opening portion of the container portion 12 is covered by the lid body 15 formed by sheet-metal bending work, but in Embodiment 3, the outer periphery of the opening portion of the container portion 12 is covered by the lid body 15 formed by sheet-metal drawing work.

In FIG. 9, reference numeral 30 denotes a drawn shape portion formed at a bent portion of the lid body 15 covering the outer periphery of the opening portion of the container portion 12.

As mentioned above, in Embodiment 3, since the outer periphery of the opening portion of the container portion 12 is covered by the lid body 15 having the drawn shape portion 30 at the bent portion, even if a fire occurs due to tracking or the like from the contained control board 10, the terminal block 11 and the like and the container portion 12 and the cover 14 are melted, the lid body 15 having the drawn shape portion 30 does not have a gap as the lid body 15 formed by sheet-metal bending work, the flame can be reliably prevented from going out of the electric equipment box 8 and spreading to the main body 1, the design panel 2 and the like.

Embodiment 4

Figure 10:
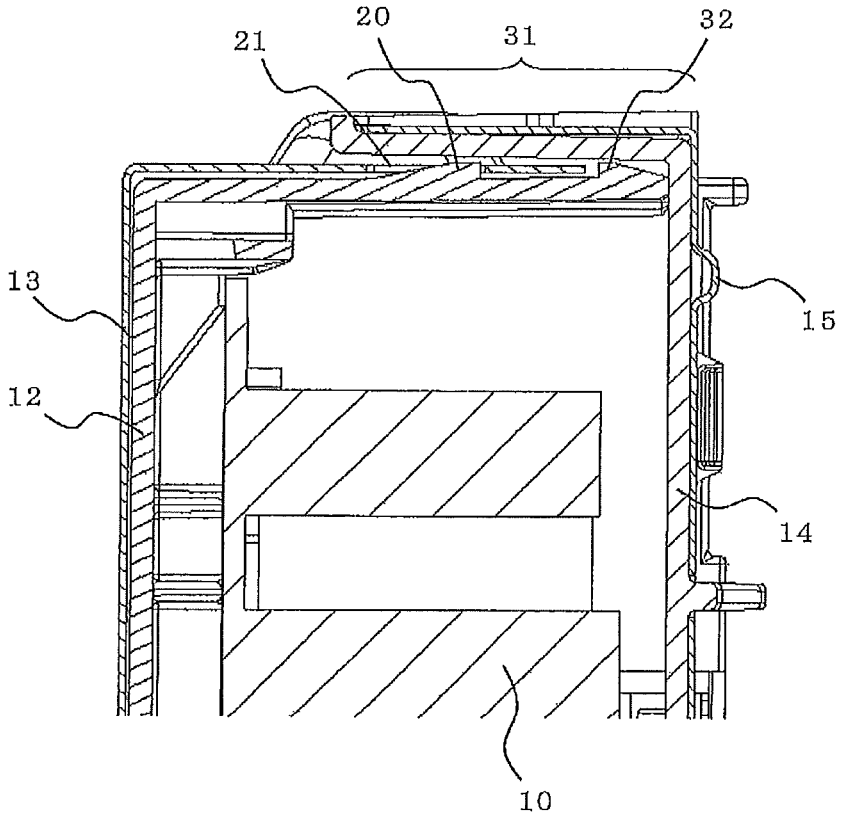
FIG. 10 is a sectional view of a portion around a locking claw of a container portion in an electric equipment box in an indoor unit of an air conditioner of Embodiment 4 of the present invention.

FIG. 10 is a sectional view of a portion in the vicinity of a locking claw of a container portion of an electric equipment box in an indoor unit of an air conditioner of Embodiment 4 of the present invention.

This Embodiment 4 is different from Embodiment 1 in the configuration of the portion in the vicinity of the locking claw of the container portion.

In Embodiments 1 to 3, as shown in FIG. 7, the locking claw 20 of the container portion 12 is formed in the basic drawing direction of a die, and it is not possible to provide a flange in parallel with the opening end at the opening edge portion of the container portion 12, and a recess shape for the plate thickness of the case 13 is made on the inner circumference side of the opening edge of the cover 14. However, in Embodiment 4, by forming the locking claw 20 of the container portion 12 using a slide die, a flange portion 32 can be disposed in parallel with the opening end at the opening edge portion of the locking claw 20 of the container portion 12. This flange portion 32 is formed with the same height dimension as the plate thickness of the case 13 over the entire outer periphery of the opening edge of the container portion 12.

As mentioned above, in Embodiment 4, by forming the locking claw 20 of the container portion 12 by the slide die, the flange portion 32 can be disposed in parallel with the opening end at the opening edge portion of the locking claw 20 of the container portion 12, and since the flange portion 32 of the container portion 12 is provided, a recess shape on the inner circumference side of the opening edge of the cover 14 is filled by the flange portion 32 and a flame spread path is constituted. Thus, even in the case of a fire due to tracking or the like from the contained control board 10, the terminal block 11 and the like, there is no risk that the flame leaves the electric equipment box 8 and spreads to the main body 1, the design panel 2 and the like of the indoor unit.

DESCRIPTION OF THE NUMERALS

1 main body, 2 design panel, 3 inlet, 4 outlet, 5 heat exchanger, 6 fan, 7 fan casing, 8 electric equipment box, 10 control board, 11 terminal block, 12 container portion, 13 case, 14 cover, 15 lid body, 16 terminal block cover, 17 terminal block case, 18 connection-line guiding member, 20 locking claw of container portion, 21 locking hole of case, 22 locking claw of cover, 23 locking hole of lid body, 30 drawn shape portion of lid body, 31 flame spread inhibiting path, 32 flange portion of container portion.

What is claimed is:

1. An air conditioner that is a wall-hung air conditioner comprising:

a heat exchanger;

a fan; and an electric equipment box in a main body of an indoor unit, wherein said electric equipment box includes:

a container portion made of resin containing a control board, a terminal block and having an opening portion with a locking claw on an outer peripheral face;

a case made of sheet metal having an opening portion with a locking hole engaged with the locking claw of said container portion on an outer periphery thereof;

a cover made of resin having an opening portion with a locking claw on an outer peripheral face thereof; and a lid body made of sheet metal having an opening portion with a locking hole engaged with the locking claw of said cover on an outer periphery thereof, wherein the locking claw of said container portion is engaged with the locking hole of said case so that said case covers the outer peripheral face of the container portion, the locking claw of said cover is engaged with the locking hole of said lid body so that said lid body covers the outer peripheral face of said cover, an engaged portion of the locking claw of said container portion and the locking hole of said case is configured to be covered by said lid body by assembling an opening edge of the opening portion of said case covering said container portion to be covered by an opening edge of the opening portion of said cover covered by said lid body, and said cover and said lid body are fixed to said container portion and said case; and between an opening end of said lid body and an opening end of said case, a flame spread inhibiting path of a predetermined length is formed in which the opening edge of said lid body and the opening edge of said case overlap.

2. The air conditioner of claim 1, wherein positions of the locking hole of said case and the locking hole of said lid body are displaced from each other so as not to overlap.

3. The air conditioner of claim 1, wherein said lid body is formed by sheet-metal drawing work.

4. The air conditioner of claim 2, wherein said lid body is formed by sheet-metal drawing work.

5. The air conditioner of claim 1, wherein a flange portion with the same height dimension as the plate thickness of said case is disposed in parallel with the opening end on the opening side of the locking claw of said container portion.

6. The air conditioner of claim 2, wherein a flange portion with a same height dimension as a plate thickness of said case is disposed in parallel with an opening end on the opening side of the locking claw of said container portion.

7. The air conditioner of claim 3, wherein a flange portion with a same height dimension as a plate thickness of said case is disposed in parallel with an opening end on the opening side of the locking claw of said container portion.

8. The air conditioner of claim 4, wherein a flange portion with a same height dimension as a plate thickness of said case is disposed in parallel with an opening end on the opening side of the locking claw of said container portion.

* * * * *